United States Patent [19]

Suzuki et al.

[11] Patent Number: 4,741,333

[45] Date of Patent: May 3, 1988

[54] DUST-FREE GARMENT

[75] Inventors: Yoshinobu Suzuki, Fujishiro; Shusaku Nisiate, Kawasaki; Kenzo Sato, Ohtsu; Masakazu Ueno, Suita; Hiroaki Shimizu, Nara; Katsunori Fujimura, Kashihara, all of Japan

[73] Assignee: Shimizu Construction Co., Ltd., Japan

[21] Appl. No.: 8,965

[22] Filed: Jan. 30, 1987

[30] Foreign Application Priority Data

Oct. 27, 1986 [JP] Japan ..... 61-253792

[51] Int. Cl.[4] ..... A62B 17/04; A62B 18/00; A41D 13/00; A41D 19/00

[52] U.S. Cl. ..... 128/201.23; 128/139; 128/910; 2/2.1 R; 2/69.5; 2/79; 2/129; 2/159

[58] Field of Search ..... 2/69, 79, 69.5, DIG. 1, 2/DIG. 7, 2.1 R, 2.1 A, 129, 159; 36/29, 35 B; 128/910, 201.29, 201.23, 202.11, 139

[56] References Cited

U.S. PATENT DOCUMENTS

| | | | |
|---|---|---|---|
| 3,529,594 | 9/1970 | Charnley | 128/910 X |
| 4,019,508 | 4/1977 | Der Estephanian et al. | 128/910 X |
| 4,055,173 | 10/1977 | Knab | 128/910 X |
| 4,223,669 | 9/1980 | Morledge | 128/910 X |
| 4,230,114 | 10/1980 | Feather | 2/69 X |
| 4,248,218 | 2/1981 | Fischer | 128/910 X |

FOREIGN PATENT DOCUMENTS

| | | | |
|---|---|---|---|
| 1266314 | 5/1969 | France | 128/910 |
| 13349 | of 1885 | United Kingdom | 128/201.29 |

*Primary Examiner*—H. Hampton Hunter
*Attorney, Agent, or Firm*—Scully, Scott, Murphy & Presser

[57] ABSTRACT

A dust-free garment including: a garment body having garment opening portions opening to the outside; an air passage system, attached to the garment body and having an outlet adapted to communicate to a dust collector for exhausting air therein to the dust collector to filter air; and an air entrance mechanism located in the vicinity of at least one of the garment opening portions and communicated to the air passage system for entering air into the air passage system.

26 Claims, 23 Drawing Sheets

DUST-FREE GARMENT

BACKGROUND OF THE INVENTION

The present invention relates to a dust-free garment used in, for example, clean rooms, and particularly relates to a dust-free garment with an air suction system.

With recent developments in electronics, medicine, brewing, etc., there are growing needs for the clean room which provides a clean air environment. For keeping the clean room at a predetermined degree of cleanliness, operators in it must wear a dust-free garment to prevent them from producing dust. For this purpose there have been proposed various dust-free garments in which the filtering effect of the garment cloth is enhanced by using highly close texture for it or by laminating it with a synthetic resin film. However, such garments do not provide sufficient dust-removing effect in view of the continuing need of a clean room having higher cleanliness. Further, the dust-free garment with a high filtering performance becomes uncomfortable since it makes the user sweaty due to a high ventilation resistance. In surgical operations, there is used a surgical gown having a sealed hood, from which air with dust is sucked into an elongated tube which is communicated to a suction pump installed in the room. This prior art garment is intended to suck expiration air of the user and does not sufficiently prevent dust from issuing from sleeve openings thereof.

Applications have studied the mechanism of producing dust in the dust-free garment and found that the force to expel dust from it to the outside is generated by the difference in pressure between the inside and outside thereof, and that contaminated air within the dust-free garment issues to its outside through garment openings such as the neck opening and sleeve openings even if the filtering performance of the garment cloth is enhanced. FIGS. 27(A) to 27(E) illustrate results of experiments in which pressure differences between the inside and outside of a conventional dust-free garment were determined in various states: the user standing under respiration (FIG. 27(A)); being seated with his arms moving vertically (FIG. 27(B)); repeating sitting and standing (FIG. 27(C)); bending and stretching his body (FIG. 27(D)); and stamping (FIG. 27(E)). It is believed that dust issues from the garment in positive pressure.

SUMMARY OF THE INVENTION

Accordingly, it is an object of the present invention to provide a dust-free garment which fairly reduces the amount of dust issuing from garment openings with comfort.

With this and other objects in view the present invention provides a dust-free garment comprising: a garment body having garment opening portions opening to the outside; an air passage system, attached to the garment body and having an outlet adapted to communicate to a dust collector for exhausting air therein to the dust collector-to filter air; and an air entrance mechanism located in the vicinity of at least one of the garment opening portions and communicated to the air passage system for entering air into the air passage system.

DETAILED DESCRIPTION OF THE PREFERRED EMBODIMENTS

Figure 1:
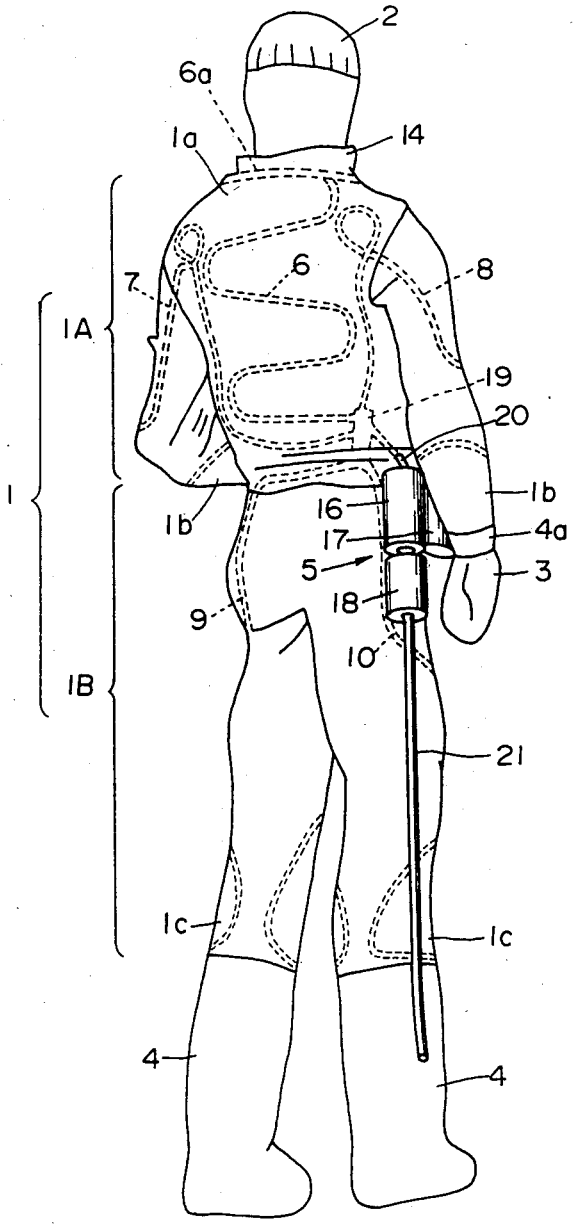
FIG. 1 is a back view of a dust-free coverall according to the present invention a user wears.

Referring now to the drawings, various embodiments of the present invention will be described. Like reference numerals designate similar parts throughout views and description thereof is omitted after once given. FIGS. 1 to 4 illustrate one embodiment of the present invention which includes a coverall or overall 1 with a hood 2, a pair of gloves 3 and 3 and a pair of socks 4 and 4 as in the prior art, but the present invention is generally distinct from the prior art in that the coverall 1 is provided in its inside with a plurality of suction tubes 6, 7, 8, 9 and 10, as an air suction passage, connected to a portable dust collecting unit 5. Suction tubes 6, 7, 8, 9 and 10 have distal end portions located at garment opening portions of the coverall 1, that is, neck opening portion 1*a*, upper sleeve opening portions 1*b* and 1*b* and lower sleeve opening portions 1*c* and 1*c*. The dust collecting unit 5 is attached to the outside of the coverall 1.

The coverall 1 includes a jacket portion 1A and trousers portion 1B integrally formed with the jacket portion 1A. The front side of the coverall 1 has a zipper (not shown) vertically attached to it for fastening front body halves together. The coverall 1 has a structure such that a conventional airtight outer cloth member 11 has an air-permeable meshed lining 12 sewn to it. The suction tubes 6–10 are interposed between the outer cloth member 11 and the lining 12. Preferably, the outer cloth member 11 is made of an air-impermeable material such as a polyvinyl chloride film for preventing air from leaking through it. In this embodiment, the coverall 1 has a neck opening 1*a*, so that introduction of air into the coverall 1 and air suction by the suction tubes 6–10 are accelerated.

Figure 3:
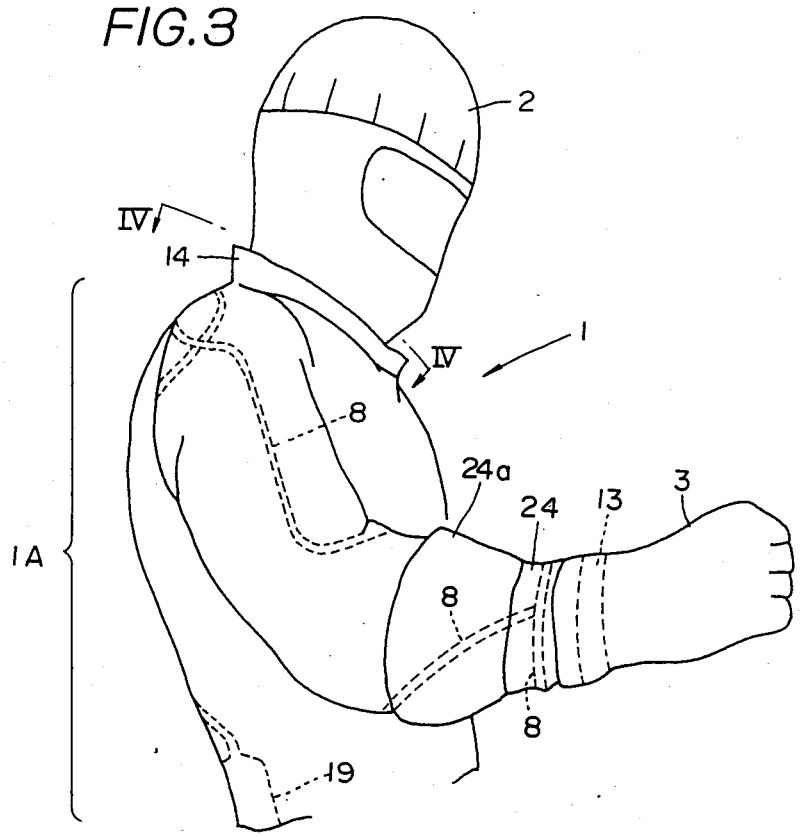
FIG. 3 is an enlarged side view of an upper portion of the dust-free coverall in FIG. 3.
Figure 4:
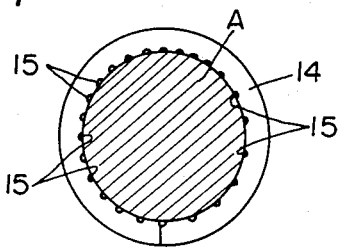
FIG. 4 is a view taken along the line IV—IV in FIG. 3.

The upper sleeve edge portions 24 and 24 of the coverall 1 each have a sleeve edge covering 24*a* sewn to it as shown in FIG. 3, the sleeve edge cover:,ng 24*a* being of the same cloth as the outer cloth member 11. Thus, the coverall 1 has a double cloth structure at the upper sleeve edge portions. Each upper sleeve edge portion 24 is provided with a conventional fastening tape 13, for example, a Velcro fastener, attached around it for detachably attaching one of the gloves 3. After the one glove 3 is attached to the fastening tape 13 as illustrated in FIG. 3, the sleeve edge covering 24*a* is placed over them as shown in FIG. 1. The neck opening portion 1*a* of the coverall 1 is provided with a closed collar 14 which is to surround the neck of the user. The closed collar 14 has many grooves 15 for communicating the inside of the coverall 1 to the outside to positively introduce air into the coverall 1, so that the dust-free garment becomes comfortable to wear.

The dust collecting unit 5 includes a suction fan 16, which is driven by an electric motor (not shown) incorporated into it, a battery 17 for supply electric power to the electric motor, a filter 18, connected to the suction fan 16 for filtering dust sucked through the fan 16 from the inside of the coverall 1. The suction fan 16, battery 17 and filter 18 are detachably held to the coverall 1 by a belt not shown. The fan 16 is communicated through a connecting tube 20 to an accumulating chamber 19 which is interposed between the outer cloth member 11 and the lining 12. The, filter 18 is preferably a high efficiency particle air (HEPA) filter. The filter 18 is connected to an elongated exhaust tube 21 which extends to one sock 4 for exhausting filtered air to the floor.

The suction tubes 6–10 may be made of a conventional flexible synthetic resin and have many suction holes 22 formed through them at predetermined intervals for sucking air. The density and the sectional area of the suction holes 22 in each portion of the coverall 1 are determined in view of dust production amount in it. For a dust-free garment for use in production of wafers, suction holes 22 are preferably formed at the largest density at sleeve edge portions 24 and 24 with the largest total sectional area thereof since dust is purged at the largest amount from those sleeve edge portions.

The suction tubes 6–10 are at their proximal ends connected to the accumulating chamber 19, which is also interposed between the outer cloth member 11 and the lining 12 and is in turn connected to the connecting tube 20 to communicate to the inlet of the suction fan 16.

In this embodiment, each of the suction tubes 6–10 is equal in inner diameter from its distal to proximal end. However, the present invention is not restricted to this structure. Preferably, the inner diameter of each of the suction tubes 6–10 is gradually enlarged from its distal to proximal end. With such a structure, pressure loss in the suction tubes 6–10 is reduced, so that necessary electric power for the suction fan 16 is fairly reduced.

The suction tube 6 extends upwards from the accumulating chamber 19 and has meandered portions 6*b* passing a back portion of the coverall 1 in a meandered manner and terminates in a ring portion 6*a*, as an air entrance tube, formed to surround the neck portion of the coverall 1. The meandered portion of the suction tube 6 provides flexibility to the coverall 1.

Each of the upper sleeve suction tubes 7 and 8 extends upwards from the accumulating chamber 19 to pass other back portions of the coverall 1 to the corresponding shoulder of the coverall 1 where it is looped at 8*b* for providing flexibility to the corresponding shoulder and arm of the coverall 1. Then, the upper sleeve suction tube 7 or 8 extends downwards around the arm to the corresponding upper sleeve edge portion 24 where it terminates in a ring-shaped portion 8*a* which surrounds the upper sleeve edge portion 24 of the lining 12.

The lower sleeve suction tubes 9 and 10 each extend downwards along corresponding lower sleeves of the coverall 1 in a meandered manner and substantially surround at their lower end portions corresponding lower sleeve opening portions 1*c* and 1*c* of the lining 12 although only parts of the lower end portions are illustrated in FIG. 1. The meandered portions of the lower sleeve suction tubes 9 and 10 provide flexibility to the lower sleeves of the coverall 1. The distal or lower end of each of the lower sleeve suction tubes 9 and 10 may terminate in a ring tube as the distal end of each upper sleeve suction tube 7, 8, the ring tube having the same structure as the ring tube 8*a*.

The suction tubes 6–10 are arranged to meet the human-factors engineering requirements. For example, the arrangement of the suction tubes 6–10 is made in view of the skeletal structure, movements of joints, working position of users. Specifically, for positive air suction with the sleeve suction tubes 7 and 8 during working, the suction tubes 7 and 8 pass the upper sleeve portions to avoid elbows, where they may be excessively squeezed with pressure, and they spirally extend around the sleeve portions for preventing bending thereof in an excessively acute manner. The suction tubes 6–8 are disposed in the back side of the overall 1 opposite to the zipper for facilitating putting on and taking off of the coverall 1. The suction tubes 9 and 10 are arranged to avoid positions where they are squeezed with pressure when the user sits.

Figure 2:
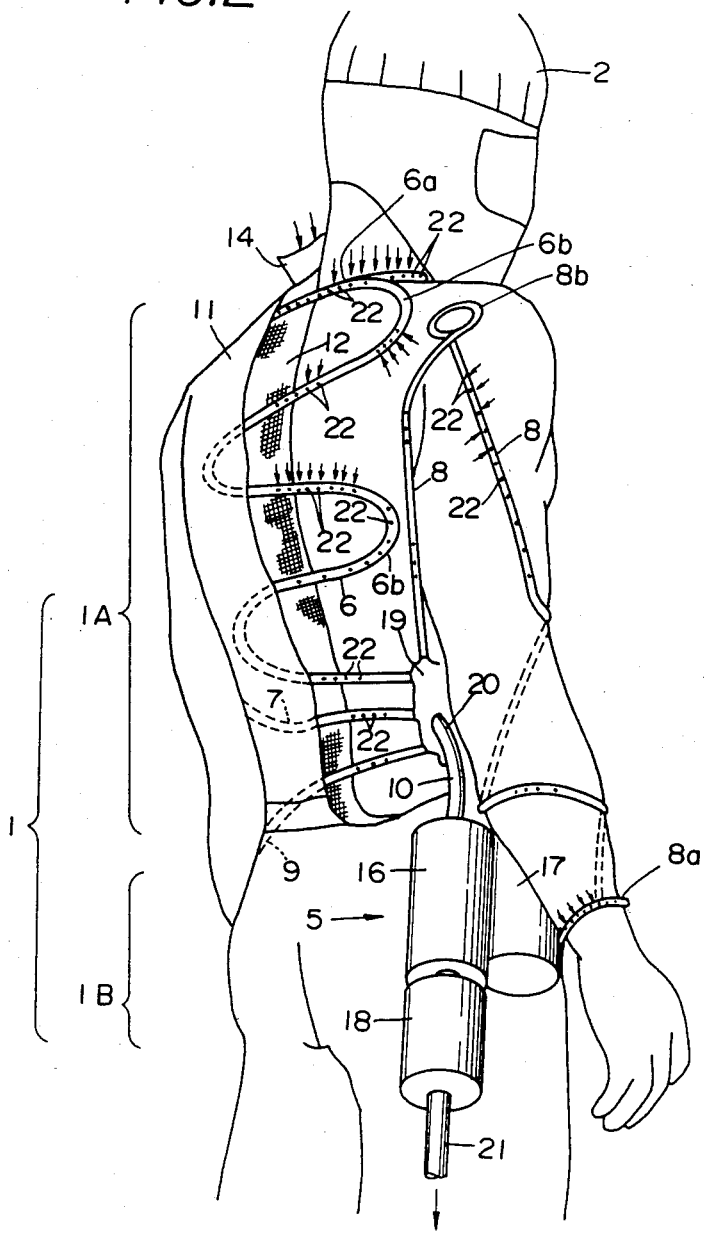
FIG. 2 is an enlarged view of the dust-free coverall in FIG. 1, with its parts broken away.

In operation, the suction fan 16 is actuated in the wearing state as illustrated in FIG. 1, so that air is, as shown in the arrows in FIG. 2, sucked through the suction holes 22 into the suction tubes 6–10, which passes the sucked air through the fan 16 to the dust filter 18 where the air is filtered and then exhausted through the exhaust tube 21 to the floor. With such suction, air pressure difference between the inside and outside of the coverall 1 is reduced, so that the amount of dust which is purged from, the collar portion 14, the upper sleeve opening portions 1*b* and the lower sleeve opening portions 1*c* to the outside due to this pressure difference is fairly decreased.

At each upper sleeve edge portion 24, the coverall 1 has three dusttight layers in which the opening portion of a corresponding glove 3 is sandwiched between the sleeve edge covering 24*a* and the upper sleeve edge portion 24. In addition, the opening portion of the glove 3 is attached to the upper sleeve edge 24 with the adhesive tape 13 for enhancing sealing of the upper sleeve edge 24. With such a construction, the dust-free garment 1 may be used in handling of wafers which require fairly high clean environment.

In this embodiment, the suction tubes 6–10 are made fairly flexible by meandering and looping them. Other conventional flexible structures, for example, bellows tubes, may be adopted for the suction tubes. Further, in this embodiment, the inner diameter of the suction tubes 6–10 is about 10 mm and the suction holes 22 having 3 mm diameter are formed in them at intervals of about 20–30 mm. The total displacement of the suction fan 16 is typically 10 l/min for such suction tubes 6–10 when the suction holes 22 are provided only to their terminal portions, i.e., ring portions 6*a*, 8*a*, etc. and when the other portions have no suction holes 22.

Figure 5:
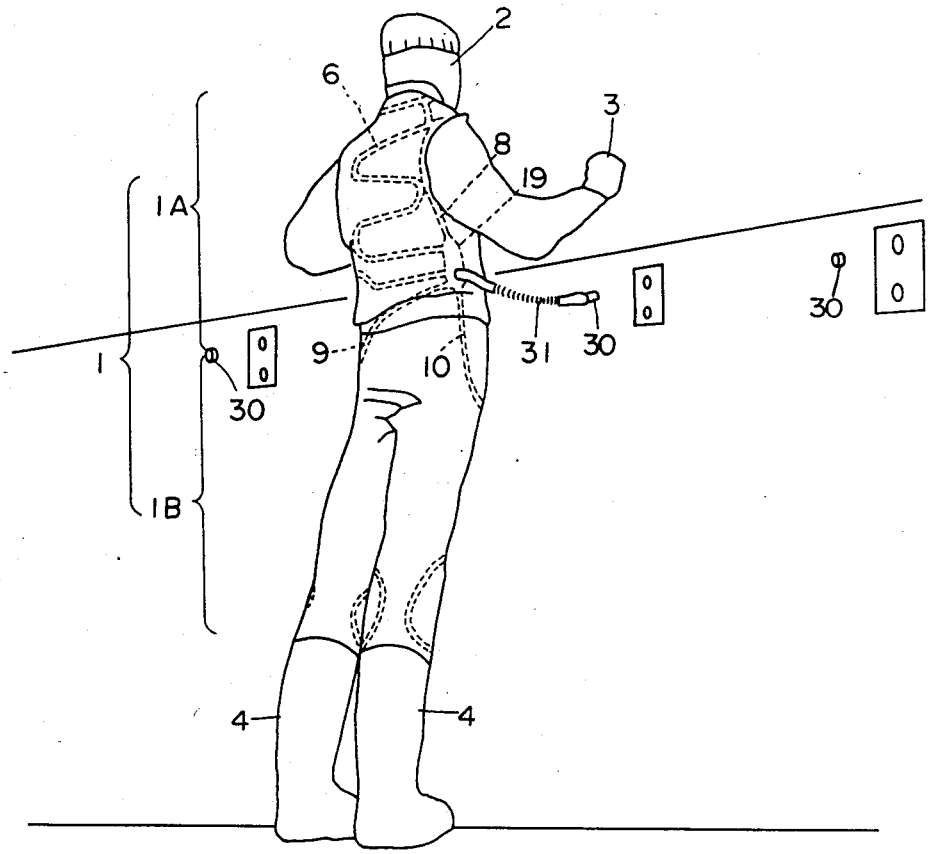
FIG. 5 illustrates a modified form of the dust-free coverall in FIG. 1, in which the air suction passage system is communicated to a dust collector installed in a clean room.

FIG. 5 illustrates a modified form of the dust-free coverall, of FIG. 1–4, for working in position. In this modification, the accumulating chamber 19 is connected to a connecting tube 31 having a bellows portion. The connecting tube 31 is detachably connected to one of suction inlets 30 mounted to a wall of a semiconductor production apparatus, the suction inlets 30 being communicated to a dust collector (not shown) disposed in the clean room. This modified dust-free garment is advantageous in that air filtering of many garments may be carried out by one dust collector. When an operator uses this dust-free garment during moving, the connecting tube 31 may be connected to the portable dust collector 5 held to the waist of the coverall 1 as shown in FIG. 1.

The suction tubes 6–10 may be directly connected to the fan 16 without provision of the accumulating chamber 19. With such a construction, suction tubes 6–10 are less liable to change in flowing rate due to change in flowing rate in other suction tubes.

Figure 6:
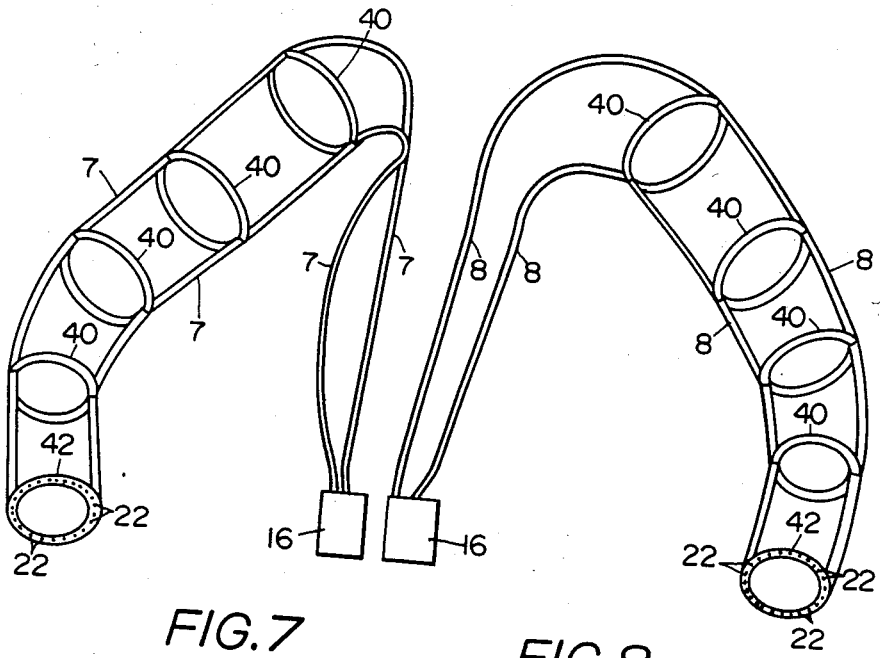
FIG. 6 is a view of a pair of sleeve air passages.

The upper sleeve suction tubes 7 and 8 may be each provided in a plurality, two in a modified form in FIG. 6, in which two pairs of independent suction tubes 7, 7 and 8, 8 increase their both reliability in air suction and flow rate of air. In this modified form, proximal ends of each pair of upper sleeve suction tubes 7, 7 and 8, 8 are directly connected to the fan 16 and distal ends thereof to the ring suction tube 42. Further, each pair of upper sleeve suction tubes 7, 7 and 8, 8 are communicated to each other in the sleeve portion through four annular tubes 40, which serve as a bypass when a portion of one associated suction tube 7 or 8 is closed, for example, by bending it at an excessively acute angle.

Figure 7:
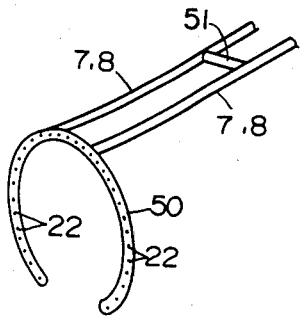
FIG. 7 is a view of a modified form of the sleeve end portion of each sleeve air passage in FIG. 6.

A modified form of the sleeve edge portion of the suction tubes 7, 7 and 8, 8 in FIG. 6 is illustrated in FIG. 7, in which the sleeve edge suction tube 50 is in the form of a horseshoe and is connected to distal ends of the upper sleeve suction tubes 7, 7 or 8, 8, which are in turn communicated to each other with connecting tubes 51 (only one of which is shown).

Figure 8:
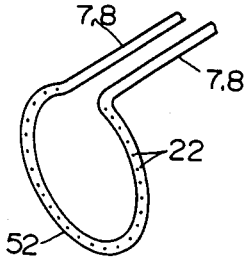
FIG. 8 illustrates another modified form of the sleeve end portion of each sleeve air passage in FIG. 6.

A further modification of the sleeve edge portion of the suction tubes 7, 7 and 8, 8 in FIG. 6 is shown in FIG. 8, in which each pair of suction tubes 7, 7 and 8, 8 are connected at their distal ends to each other to form a substantially horseshoe-shaped portion 52.

The sleeve edge suction tube 50 and 52 may be used in both the neck portion 1*a* and the lower sleeve edge portion 1*c*.

Figure 9:
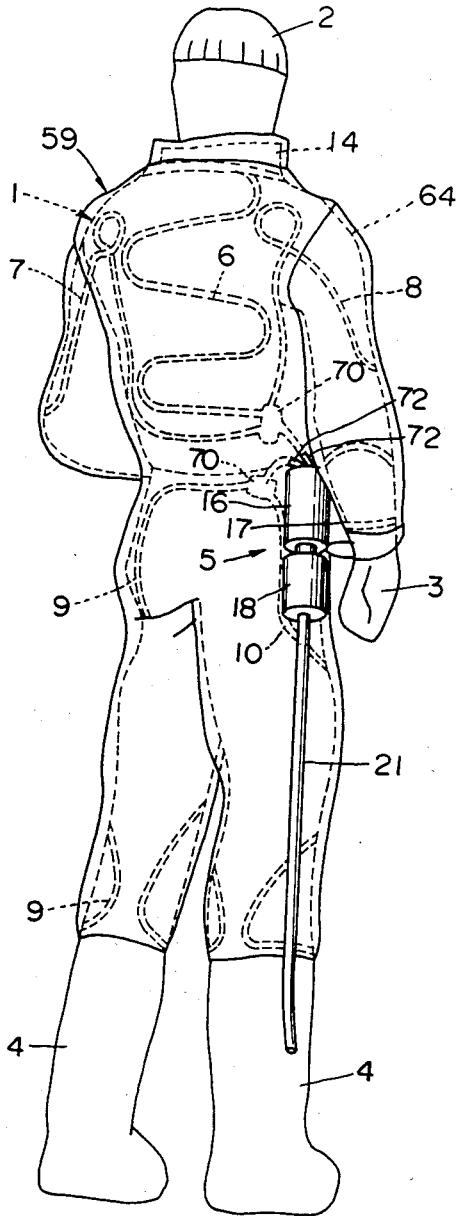
FIG. 9 is a view showing another embodiment of the present invention, in which the dust free garment is covered with an outer coverall.
Figure 10:
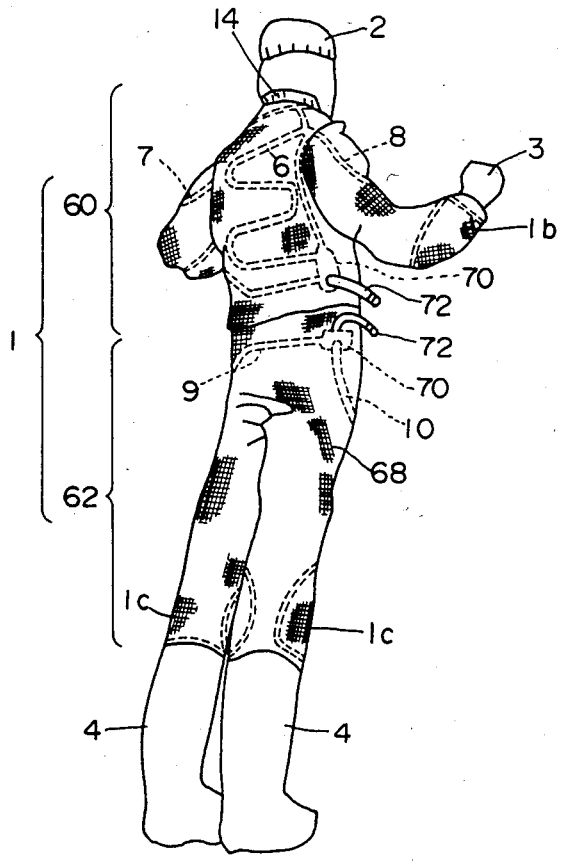
FIG. 10 is a view in a reduced scale of the dust free garment in FIG. 9.
Figure 11:
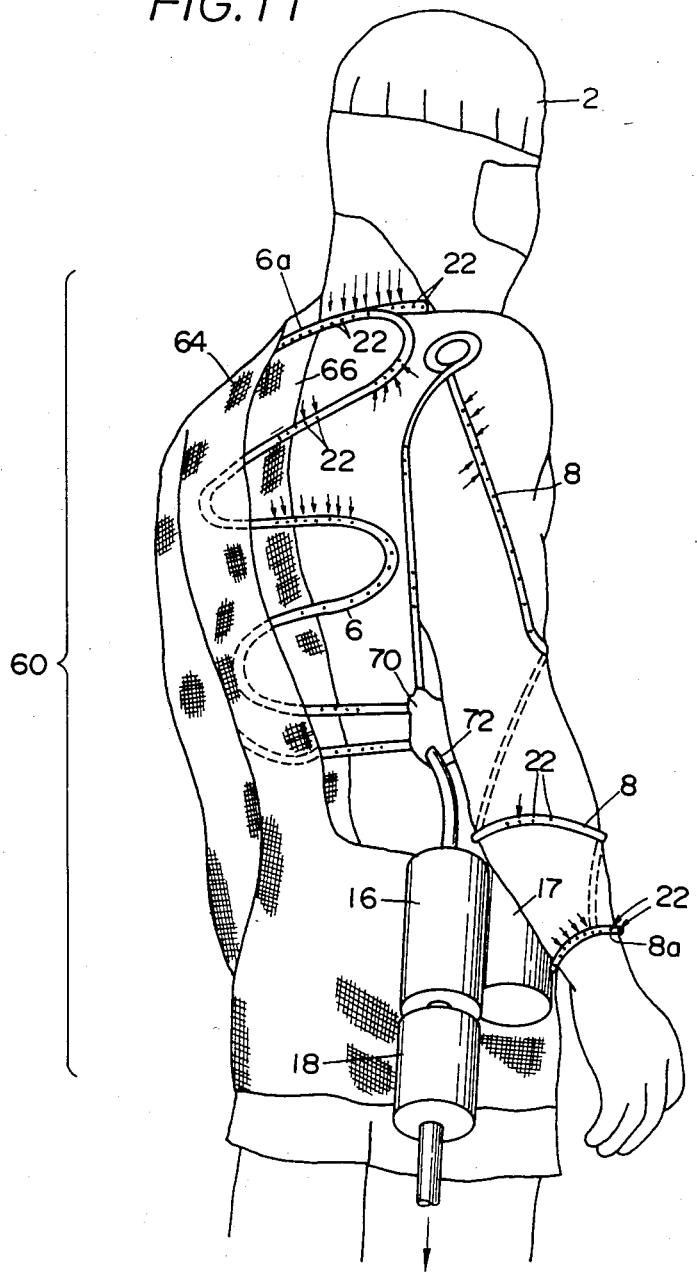
FIG. 11 is an enlarged view of the jacket portion, partly broken away, of the dust-free garment in FIG. 10.

FIGS. 9–11 illustrate another embodiment of the present invention, which is generally distinct from the embodiment in FIGS. 1–5 in that the dust free garment is put on under a conventional air-impermeable outer coverall 59. The dust-free garment has a two piece air-permeable structure, including a meshed shirt 60 and meshed underpants 62. The shirt 60 is fastened at its front body halves with a zipper fastener (not shown) and the underpants 62 fit to the user with a rubber band (not shown) attached to a waist portion thereof. The shirt 60 has a meshed covering cloth member 64, a meshed lining 66, sewn to the meshed covering cloth member 64, and air suction tubes 6–8 sandwiched between them. The underpants 62 have a meshed covering cloth member 68, a meshed lining (not shown), sewn to the meshed covering cloth member 68, and air suction tubes 9 and 10 similarly sandwiched between them. The shirt 60 and underpants 62 have each a separate accumulating chamber 70. The two accumulating chambers 70 and 70 are connected through respective connecting tubes 72 and 72 to the suction fan 16. In this embodiment, air is introduced into the suction tubes 6–10 through both the covering cloth members and the linings.

Although the dust-free garment in this embodiment consists of two pieces, it may have a one piece structure, in which case a single accumulating chamber 19 is used instead of two and it may be connected through connecting tube 31 to a dust collector installed to a semiconductor production apparatus as illustrated in FIG. 5.

Figure 12:
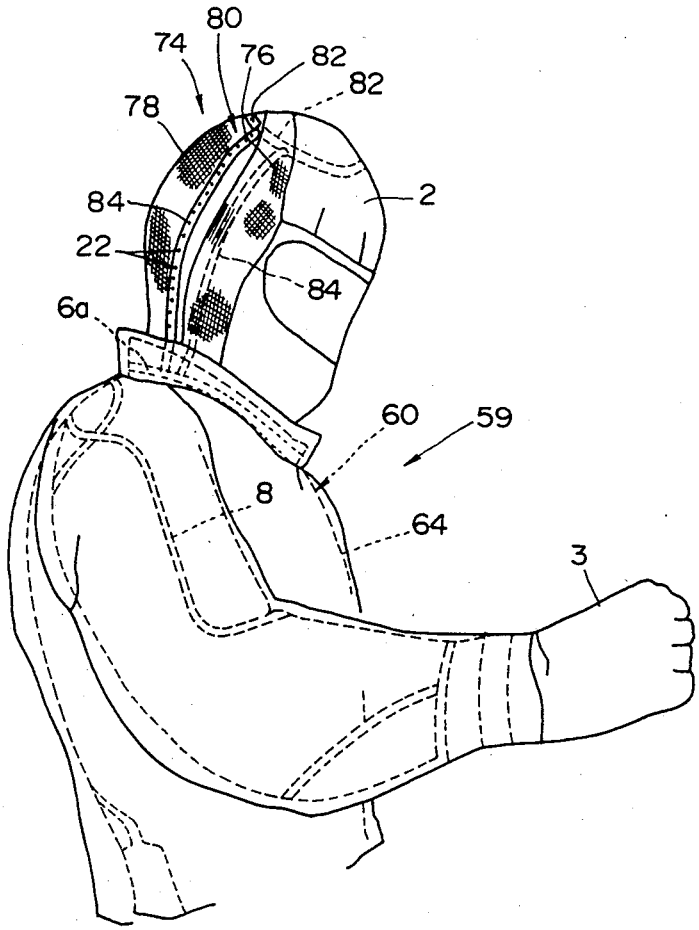
FIG. 12 is a view of a modified form of the part of the dust-free garment in FIG. 10, partly broken away.

FIG. 12 illustrates another embodiment of the present invention, which is distinct from the embodiment in FIGS. 9–11 in that a hood portion 74 is integrally forned with the dust-free garment. The hood portion 74 includes a meshed covering member 76, a meshed lining 78, sewn to the covering member 76, and a hood air suction passage system 80 interposed between the covering member 76 and the lining 78. The hood air suction passage system 80 includes a head top suction ring tube 82 and connection suction tubes 84 connecting the ring tube 82 to the ring portion 6*a* of the suction tube 6 at the neck. Both the ring tube 82 and the connection suction tubes 84 also have suction holes 22 formed through it as in the suction tubes 6–10. When used, the hood portion 74 is covered with a hood 2 attached to the outer covering 11.

Figure 13:
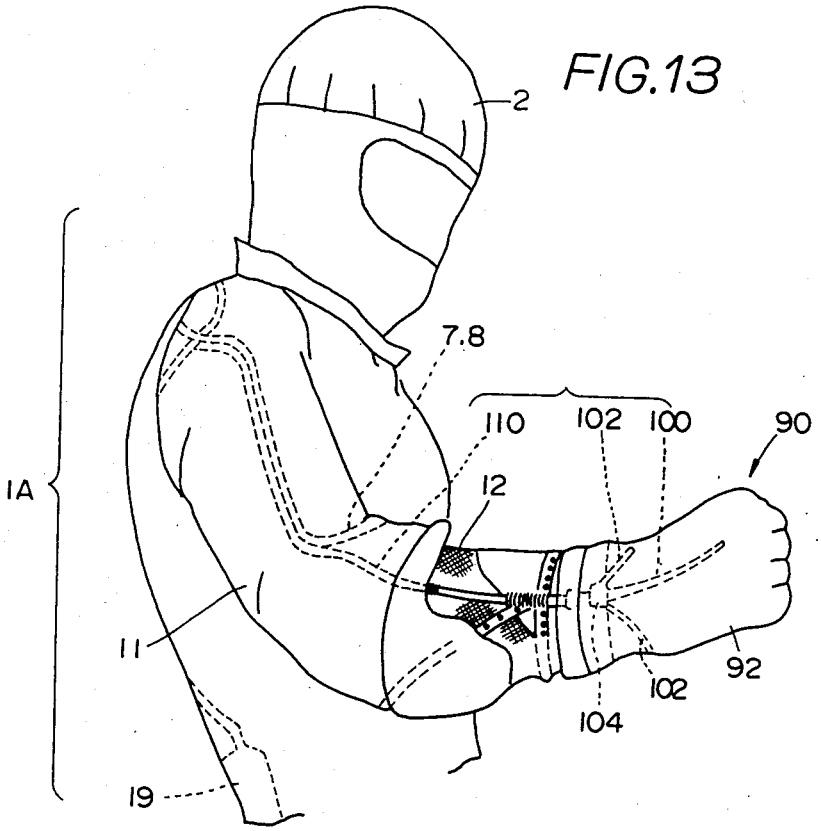
FIG. 13 is a view of part of a further modification of the dust-free garment in FIG. 10 with a broken part for illustration purpose.
Figure 14:
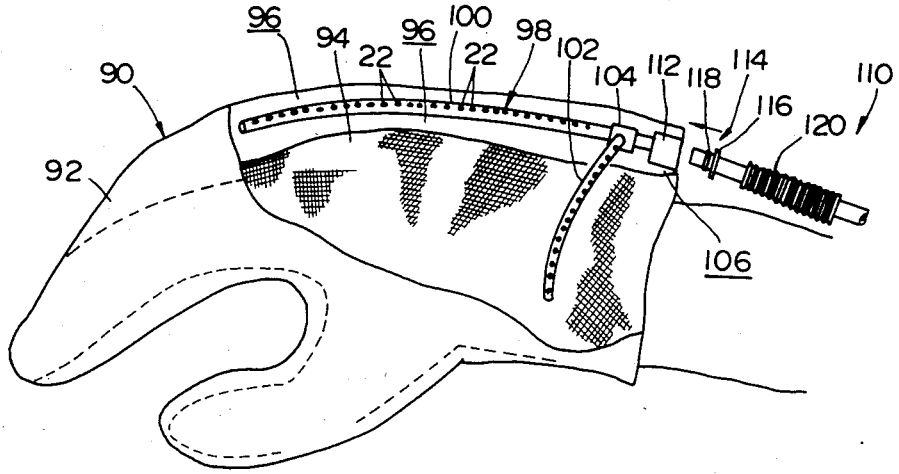
FIG. 14 is an enlarged view, partly broken away, of the glove in FIG. 13.

Another embodiment of the present invention is illustrated in FIGS. 13 and 14, in which the dust free garment 1 in FIG. 1 is provided with a pair of dust-free gloves 90 and 90 although only one glove 90 is shown in FIGS. 13 and 14. Each dust-free glove 90 includes a conventional glove covering 92, a meshed glove lining 94, sewn to the covering 92 to form a suction tubes receiving space 96, and a glove air suction system 98 interposed between the glove covering 92 and the lining 94 and appropriately sewn to them.

The glove air suction system 98 includes a main suction tube 100, and a pair of branch suction tubes 102 branched from the main suction tube 100 through a distributing connector 104 mounted to a proximal portion of the main suction tube 100 for communication between the main and branch suction tubes 100 and 102. The main suction tube 100 and the branch suction tubes 102 also have many suctions holes 22 formed through them as the suction tubes 6–10. The suction tubes receiving space 96 has an opening 106 having a size sufficient to allow the distal end of connecting tube 110 to pass it. The proximal end of the main suction tube 100 has a hollow cylindrical female connector 112 mounted to it at the opening 106 of the suction tube receiving space 96. The main suction tube 100 is communicated to the suction tube 7 or 8 through a connecting tube 110 interposed between the covering 11 and the lining 12 of each arm of the dust-free garment 1. The connecting tube 110 has a male connector 114 formed in its distal end portion. The male connector 114 has an annular flange 116, integrally formed with the distal end portion of the connecting tube 110, and an annular projection 118 projecting radially outwards from the connecting tube 110 and spaced from the annular flange 116 toward the distal end of the connecting tube 110. For connecting the glove air suction passage system 98 to the connecting tube 110, the distal end of the latter is inserted into the female connector 112, so that the annular projection 118 resiliently and detachably engages with an annular groove (not shown) formed in the inner face of the female connector 112. The connecting tube 110 has an expandable portion 120 provided with bellows for facilitating fitting of the male connector 114 to the female connector 112. When the suction fan 16 is actuated, air in each of the gloves 90 is sucked in the corresponding main and branch suction tubes 100 and 102 through suction holes 22 and then passes through the connection tube 110 and then through suction tubes 7 or 8 to the accumulating chamber 19, from which it is introduced into the suction fan 16, filtered in the filter 18 and exhausted via the exhaust tube 21 to the outside. During this sucking, fresh clean air is introduced from the clean room through clearances, which are defined between the female connector 112 and the walls of the openings 106, into the gloves 90 and 90. The hands are prevented from becoming sweaty since the clean air is kept at a relative humidity within 50%. For taking off the gloves 90 and 90, the connectors 112 and 114 are detached.

Figure 15:
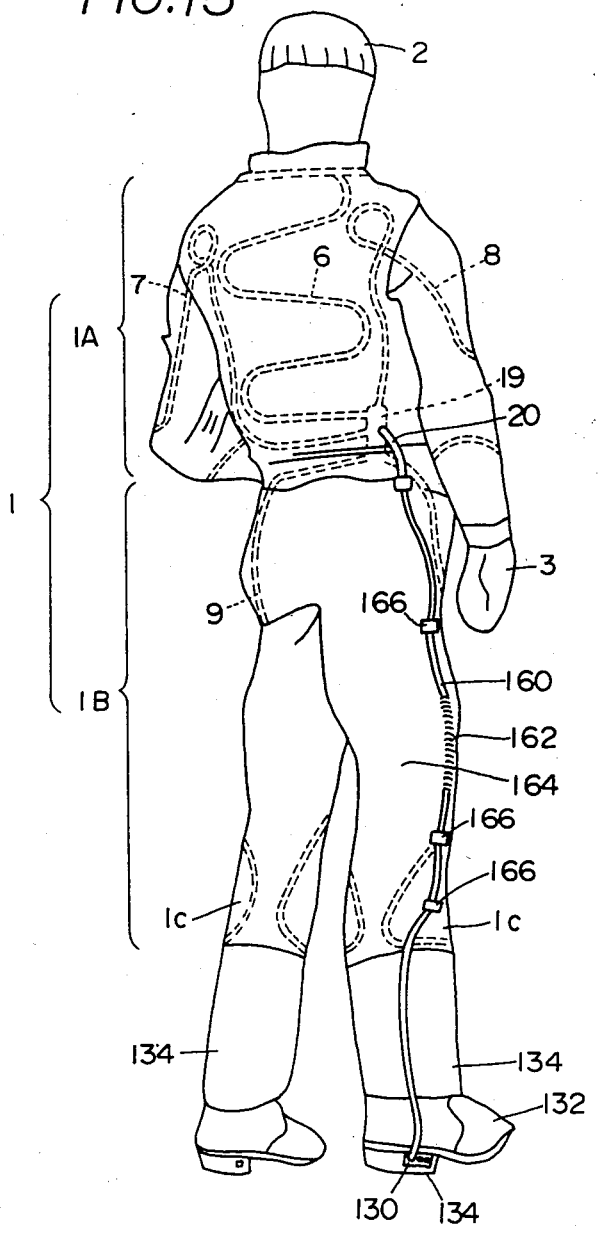
FIG. 15 is a rear view of a modified form of the dust-free overall in FIG. 1.
Figure 16:
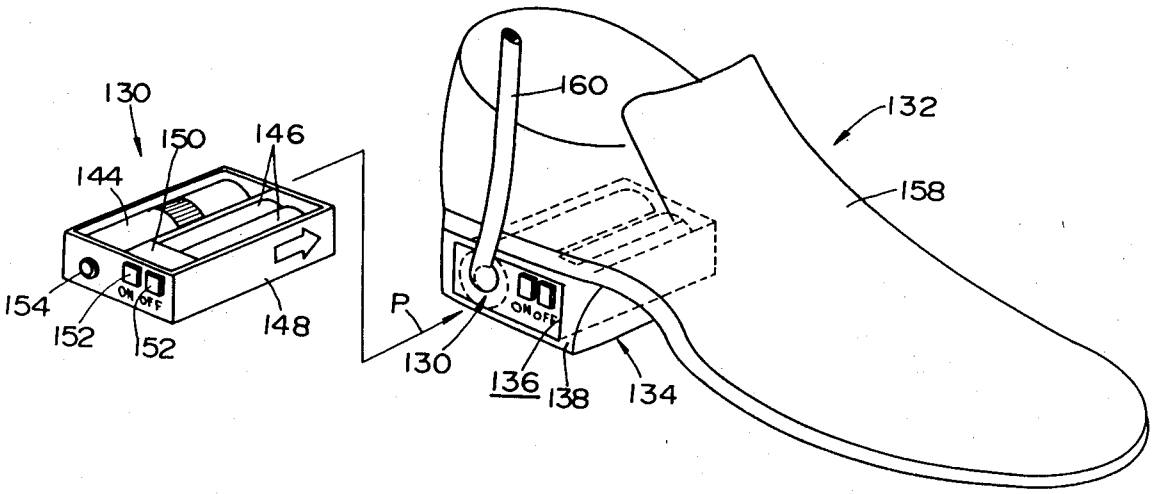
FIG. 16 is an enlarged perspective view of one shoe in FIG. 15.
Figure 17:
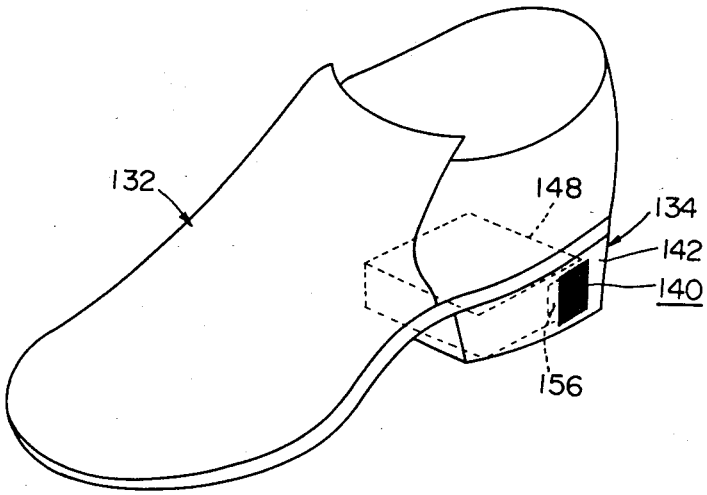
FIG. 17 is an enlarged perspective view of the one shoe in FIG. 15 seen from the other side.

FIGS. 15 to 17 illustrate another embodiment of the present invention, in which a dust collecting unit 130 is provided to a heel 134 of one shoe 132. The heel 134 has a dust collecting unit receiving recess 136, formed in its one side wall 138, and an exhaust opening 140 formed through the other side wall 142. The dust collecting unit 130 is fitted into the receiving recess 136. The dust collecting unit 130 includes an electric suction fan 144, two batteries 146 and 146 to supply electric power to the suction fan 144 and a casing 148 having the shape of a hollow rectilinear box and receiving the suction fan 144 and the batteries 146, 146 in it. The casing 148 is further provided with a suction fan electric controlling unit 150 having on-off switch buttons 152, 152 mounted to the front wall of the casing 148. The suction fan 144 has an inlet pipe 154, passing through the front wall of the casing 148, and an outlet (not shown) to be located for communicating to an exhaust opening 156 formed through the rear wall of the casing 148, the exhaust opening 156 designed to communicate to the exhaust opening 140 of the heel 134. A solar cell may be mounted on the instep 158 of the one shoe 132 for supplying auxiliary power to the suction fan 144. One end of a connecting tube 160 fits around the inlet pipe 154 of the suction fan 144 and the other end is connected to outlet tube 20 of the accumulating chamber 19 for communicating the suction fan 144 to the suction tubes 6–10. The connecting tube 160 has a bellow portion 162 and is attached to one leg 164 of the trousers portion 1B with bands 166 sewn to the latter. The openings of the shoes 132 are each covered with a spat 134 as shown in FIG. 15. The casing 148 is pushed into the recess 136 of the one shoe 132 in the direction P (FIG. 16) and resiliently locked to the walls of the recess 136. In this state, the outlet of the suction fan 144 communicates through the exhaust opening 156 of the casing 148 to the exhaust opening 140 of the heel 134. Thus, air in the dust-free garment 1 which has been sucked in the suction tubes 6–10 and introduced into the accumulating chamber 19 passes through the connection tube 160 into the suction fan 144 and then exhausted from the exhaust opening 140 of the heel 134.

In this embodiment, no filter is used in the dust collecting unit 130 since air exhausted from it is sucked by a dust collecting apparatus mounted to the floor. However, a HEPA filter may be provided to the outlet of the suction fan 144 when needed. The connection tube 160 may be arranged to extend between the covering 11 and the lining 12 of the leg 164 of the dust-free garment 1.

Figure 18:
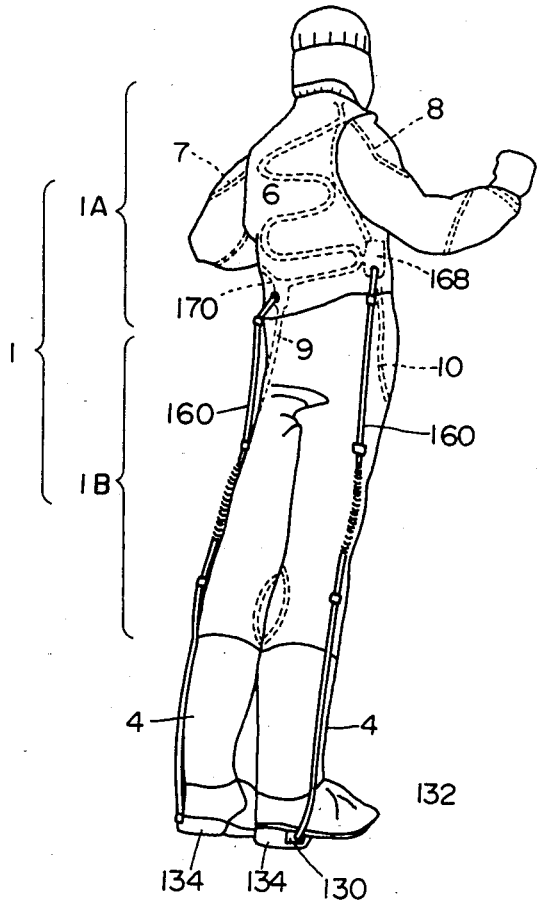
FIG. 18 is a perspective view in a modified scale of a modified form of the dust-free overall in FIG. 15, seen from the rear side.

In FIG. 18, a pair of the dust collecting units 130 are provided. In this modified form, a pair of accumulating chambers 168 and 170 are furnished to the Jacket portion 1A, one accumulating chamber 168 being communicated to the suction tubes 8 and 10 for right half of the body and the other to the suction tubes 7 and 9 for the left half. The two accumulating chambers 168 and 170 are communicated through connecting tubes 160 and 160 to dust collecting units 130 and 130 in heels 134 of the shoes, respectively. With such a construction, the suction fans 144 may be reduced in size.

Figure 19:
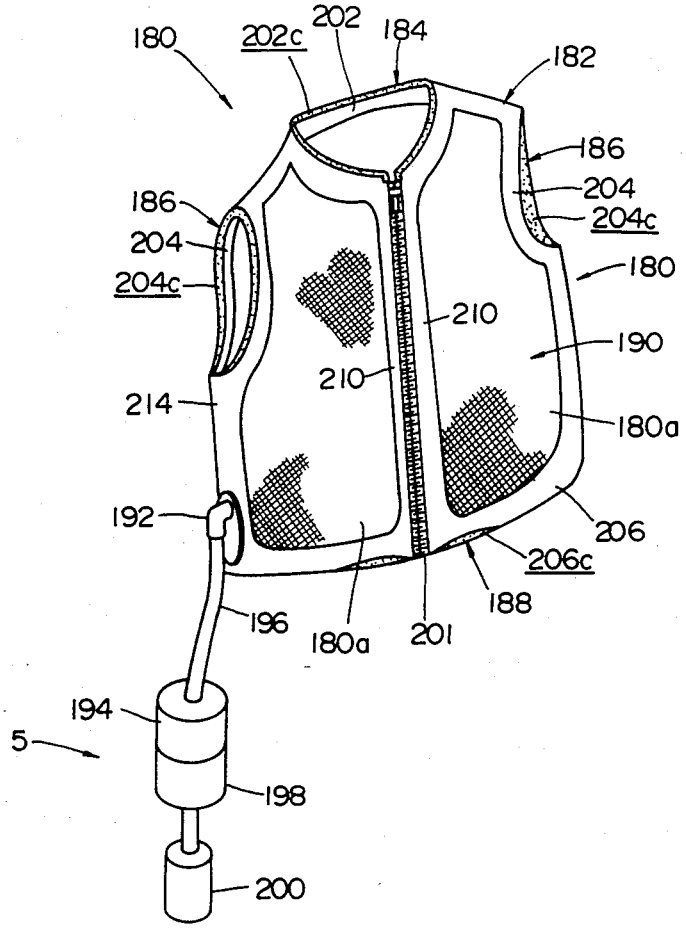
FIG. 19 is a perspective view of another embodiment of the present invention in which the dust-free vest is connected to a portable dust collector.

FIGS. 19–21 illustrate another embodiment of the present invention, in which an air passage system 182 according to the present invention is furnished to a vest 180 having a neck opening portion 184, a pair of sleeve opening portions 186 and a waist opening portion 188. The vest 180 includes: a vest body 190, formed of meshed polyester or nylon cloth in the shape of a vest; the air passage system 182 sewn to the vest body 190 to define the opening portions 184, 186, 186 and 188 at which it is open to the atmosphere, the air suction passage system 182 having an outlet pipe 192; a filter 194 communicated to the outlet pipe 192 through a connecting tube 196; a dust collector 198 communicated to the filter 194; and a suction pump 200 communicated to the dust collector 198. The front body halves **180*a* and 180*a* of the vest 180 are fastened with a zipper 201**.

Figure 20A:
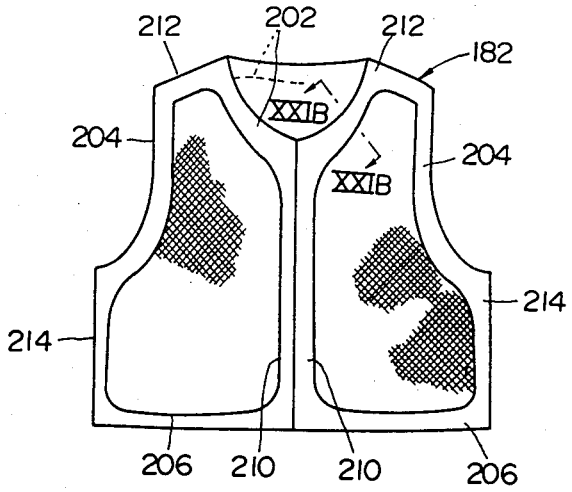
FIG. 20(A) is a front view of the dust-free vest in FIG. 19.
Figure 20B:
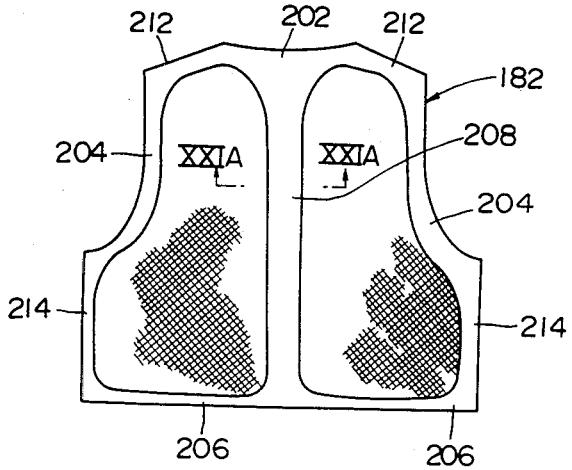
FIG. 20(B) is a rear view of the dust-free vest in FIG. 20(A)

In FIGS. 20(A) and 20(B), there is shown an arrangement of the air passage system 182, which includes a neck air passage 202 in the form of a collar, a pair of annular sleeve air passages 204, 204 and a waist air passage 206, these passages 202, 204, 204 and 206 defining the neck opening portion 184, the sleeve opening portion 186 and 186 and the waist opening portion 188, and as shown in FIG. 19, having air entrance openings 202*c*, 204*c*, 204*c* and 206*c* opening to the atmosphere, respectively. The neck air passage 202 communicates to the waist air passage 206 through a back center air passage 208 sewn to the center of the back of the vest body 190. Further, the neck air passage 202 communicates to the waist air passage 188 through a pair of front vertical air passages 210 and 210 to which the zipper 201 is sewn. The two sleeve air passages 204 and 204 are communicated to the neck air passage 202 through respective shoulder air passages 212 and 212 and to the waist air passage 206 through respective side air passages 214 and 214.

Figure 21A:
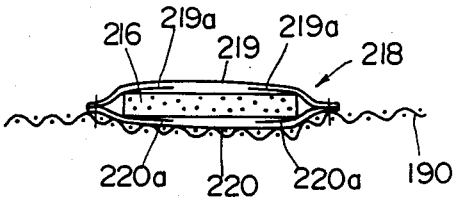
FIG. 21(A) illustrates an enlarged cross-section taken along the line XXIA—XXIA in FIG. 20(B)

FIG. 21(A) illustrates a cross-section of each of the air passages 208, 212, 212, 214, 214, in which a band spacer 216, which has a rectangular cross-section and is made of highly air-permeable material such as a sponge rubber, is enclosed within an air passage tube 218. In this embodiment, a polyurethane sponge 5 mm thick is used as the band spacer 216. The air passage tube 218 is made of air-impermeable cloth or cloth of such a low air permeability or high air permeation resistance that air may be sucked from air entrances of the air passage system 182 and smoothly passes through the tube 218 when the suction fan 194 is actuated. In this embodiment, the air passage tube 218 includes an upper cloth band 219 and a lower cloth band 220. Both the cloth bands 219 and 220 are folded inwards at their opposite peripheries 219*a*, 219*a* and 220*a*, 220*a* and sewn at their opposite folded edges 219*b*, 219*b* and 220*b*, 220*b* to the vest body 190. The band spacer 216 serves to secure the air flow passage within the air passage tube 218 against force exerted on the latter.

A nylon or polyester knit fabric, coated or laminated with a polyurethane or a polyacrylic resin, may be adapted for the air passage tube 218. With such a construction, the air passage tube 218 provides to the vest 180 both smooth air ventilation and high flexibility. The upper and lower bands 219 and 220 may be bonded to form the air passage tube 218.

Figure 21C:
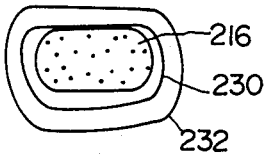
FIG. 21(C) is an enlarged cross-section of a modified form of the air suction passage in FIG. 21(A)
Figure 21B:
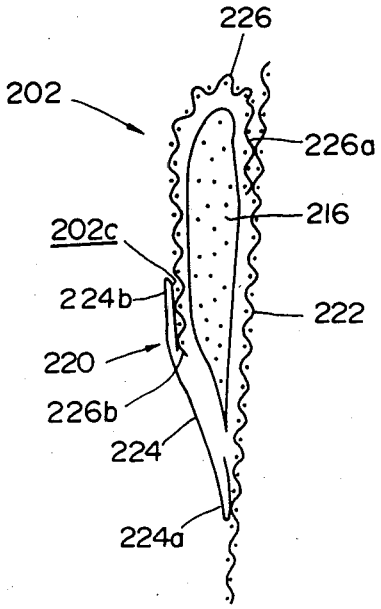
FIG. 21(B) illustrates an enlarged cross-section taken along the line XXIB—XXIB in FIG. 20(A)

As shown in FIG. 21(B), each of the neck air passage 202, the sleeve air passages 204, 204 and the waist air passage 206 has band spacer 216 enclosed in another air passage tube 220. The air passage tubes 220 each includes: a marginal portion 222 of a corresponding garment opening portion 184, 186, 186 or 188 of the vest body 190; a band 224 made of the same material as the bands 219, 220 and sewn at its one edge 224*a* to the corresponding marginal portion 222 of the vest body; and another meshed and flexible band 226 made of two-way tricot stitch cloth and sewn at its one edge 226*a* to the another part of the marginal portion 222 of the vest body 190 and at the other edge 226*b* to the other edge 224*b* of the band 224. Each band spacer 216 is exposed through the meshed band 226 which serves as air entrance means and has high air permeability.

The user puts on the vest 180 between an outer garment and an undershirt or under the outer garment without any undershirt. After fastening the zipper 201 of the front of the vest 180, the outlet pipe 192 is, as shown in FIG. 19, connected to the connecting tube 196 of the portable dust collecting unit which is held at one hip of the outer garment of the user with a belt not shown. Thus, negative pressure is generated in each of the neck air passage 202, the sleeve air passages 204, 204 and the waist air passage 206 by actuating the pump 200, so that dust, produced around those passages, is sucked with air through the meshed bands 226 into the air passage system 182 and led to the filter 194 through the outlet pipe 192 and the connecting tube 196. Filtered air is thus drawn off from the suction pump 200. The suction pump 200 may be provided with the exhaust tube 21 as in FIG. 1 for discharging filtered air at one foot of the user.

The dust-free garment in FIGS. 19, 20(A) and 20(B) is more comfortable than the preceding embodiments since there is no adhesion of the air passage tubes to the body of the user. The adhesion of suction tubes 6–10 may occur in the preceeding embodiments due to air suction of suction holes 22. Futher, this embodiment is advantageous over the preceding embodiments in that it is put on and taken off with ease and in that washing thereof is facilitated.

A modified form of the air passage tube 218 in FIG. 21(A) is illustrated in FIG. 21(C), in which the spacer band 216 is enclosed in an air-impermeable polyurethane film tube 230, which is then enclosed in a tube 232 made of two-way tricot stitch cloth.

Figure 21D:
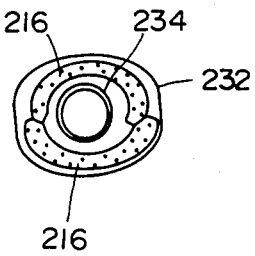
FIG. 21(D) is an enlarged cross-section of another modified form of the air suction passage in FIG. 21(A)

A further modified form of the air passage tube 218 in FIG. 21(A) is shown in FIG. 21(D), in which a polyvinyl chloride tube 234 is covered with a pair of spacer bands 216, 216 along its axis and the spacer bands 216, 216 are enclosed in two-way tricot stitch cloth tube 232.

The air passage system 182 may be detachably fastened to the vest body 190 by means of conventional fasteners, such as snap hooks and magic tapes.

The vest 180 may be connected to a dust collector installed in the room as illustrated in FIG. 5 or it may be communicated through an elongated tube to the outside of the clean room for exhausting filtered air.

Although the vest 180 has no collar, the present invention is not limited to this shape. For example, the neck air passage 202 may be provided with a closed collar open to the atmosphere at its upper edge. The closed collar may have a height such that dust produced from the head cap of the user is efficiently sucked.

Figure 22A:
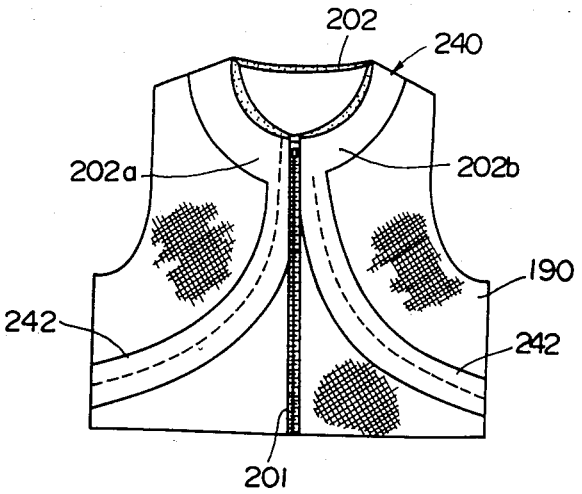
FIG. 22(A) is a front view of a modified form of the vest in FIG. 19.
Figure 22B:
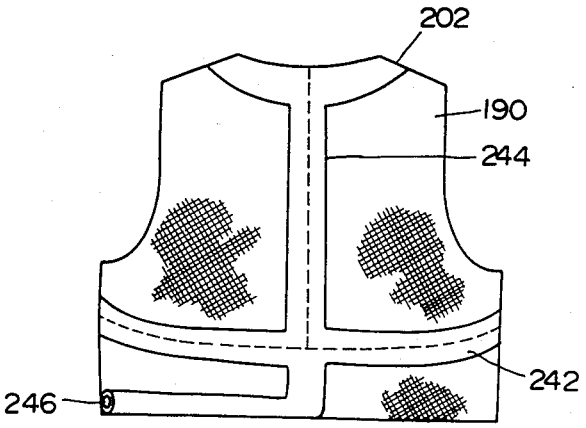
FIG. 22(B) is a rear view of the vest in FIG. 22(A)

A modified form of the vest 180 in FIGS. 19, 20(A) and 20(B) is illustrated in FIGS. 22(A) and 22(B), in which the air passage system 240 of this modification opens to the atmosphere only at the neck air passage 202, which is communicated at its opposite front ends 202*a*, 202*b* to circumferential air passage 242 sewn to the vest body 190, the circumferential air passage 242 extending from the front ends 202, 202 through the chests and the sides to the back of the vest body 190. The neck air passage 202 and the circumferential air passage 242 are communicated at the back of the vest body 190 through a connecting back air passage 244 sewn to that back. The circumferential air passage 242 is connected to an outlet tube 246 at the back.

Figure 23A:
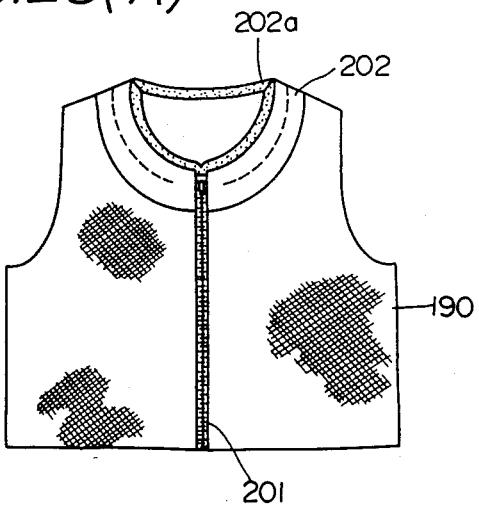
FIG. 23(A) is a front view of a modified form of the vest in FIG. 19.
Figure 23B:
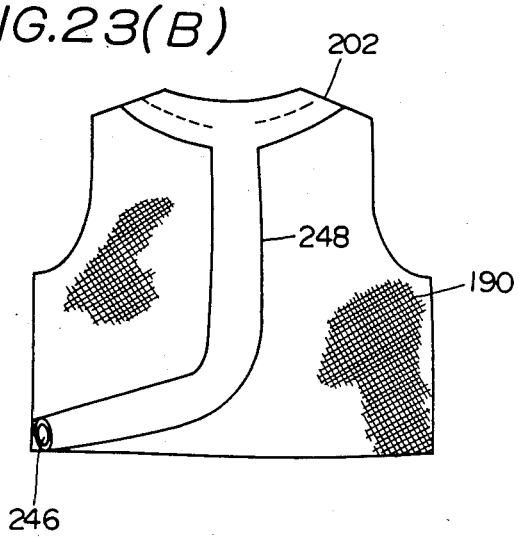
FIG. 23(B) is a rear view of the vest in FIG. 23(A)

The vest shown in FIGS. 23(A) and 23(B) is distinct from the vest in FIGS. 22(A) and 22(B) in that the neck air passage 202 is communicated to a back air passage 248 which extends vertically along the center of the back of the vest body 190 and terminates in the outlet tube 246.

Figure 24A:
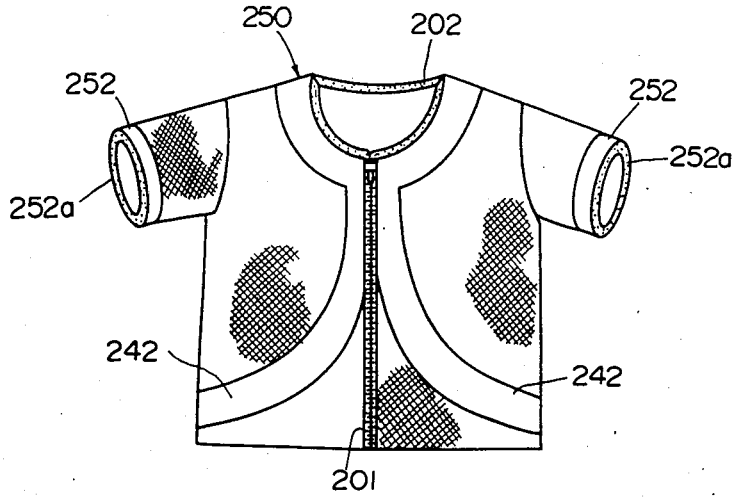
FIG. 24(A) is a front view of a modified form of the vest in FIG. 22(A)
Figure 24B:
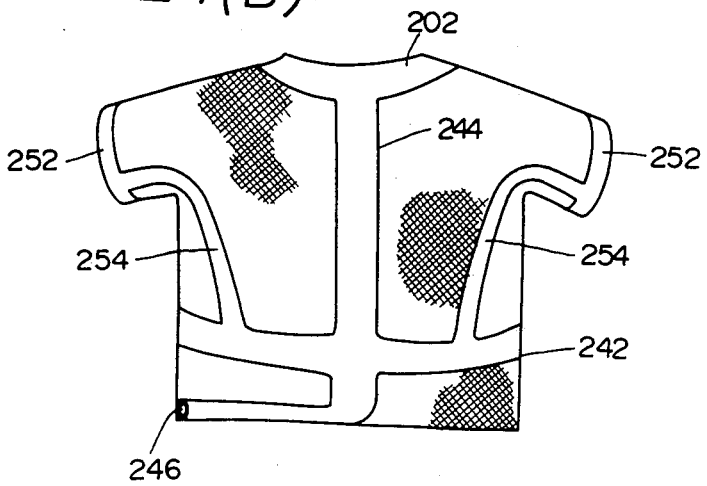
FIG. 24(B) is a rear view of the vest in FIG. 24(A)

FIGS. 24(A) and 24(B) illustrate a dust-free T-shirt according to the present invention, of which air passage system 250 is distinct from that of the vest in FIGS. 22(A) and 22(B) in that annular sleeve air passage 252 is provided to the each sleeve opening portion of the vest so that it opens at its circumferential air entrance opening 252*c* to the atmosphere. The sleeve air passages 252 have the same cross-sectional structure as the neck air passage 202 in FIG. 21(B). The sleeve air passages 252 are each communicated through a connecting air passage 254 to the circumferential air passage 242 in the back of the T-shirt for passing air from them to the circumferential air passage 242.

Figure 25A:
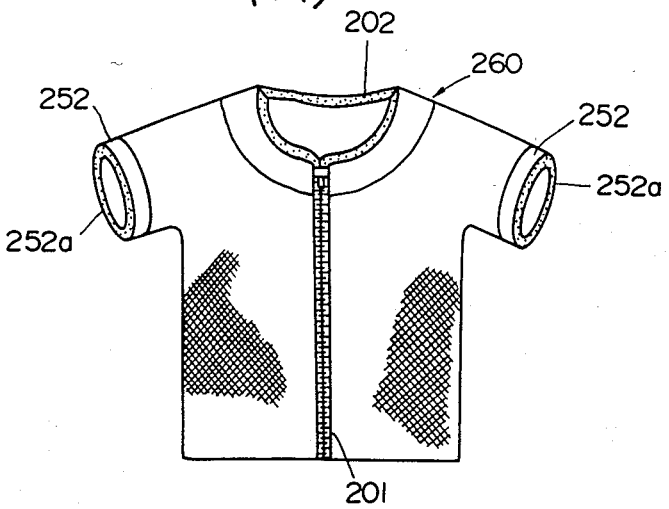
FIG. 25(A) is a front view of a modified form of the vest in FIG. 23(A)
Figure 25B:
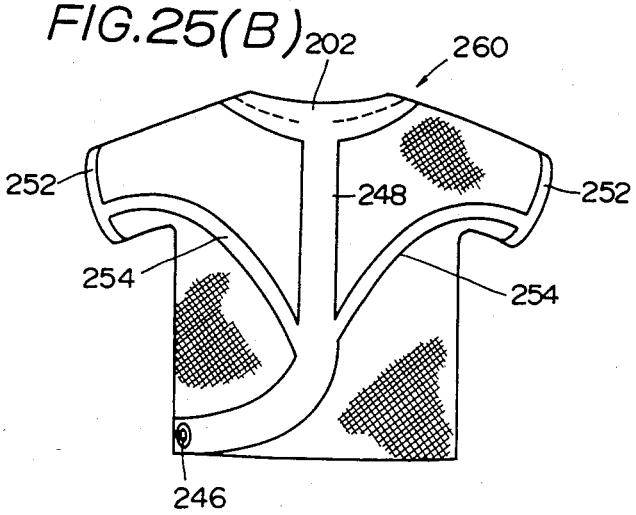
FIG. 25(B) is a rear view of the vest in FIG. 25(A)

FIGS. 25(A) and 25(B) show another dust-free T-shirt according to the present invention, of which air passage system 260 is distinct from that of the vest in FIGS. 23(A) and 23(B) in that annular sleeve air passage 252 is, as in FIGS. 24(A) and 24(B), provided to each sleeve opening portion thereof so that it opens at its circumferential edge to the atmosphere. The sleeve air passages 252, 252 are each communicated through a connecting air passage 254 to the back air passage 248.

Figure 26:
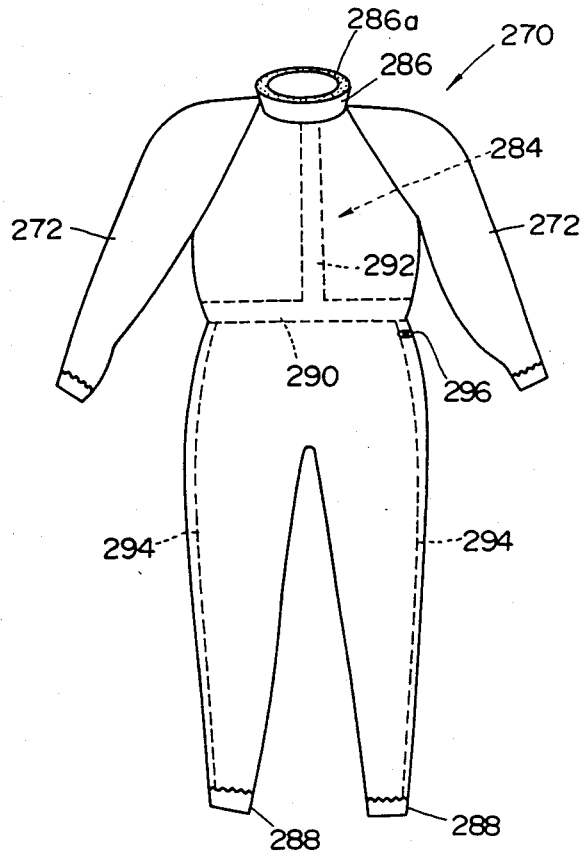
FIG. 26 is a rear view of another embodiment of the present invention.
Figure 27A:
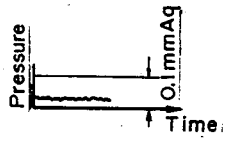
FIG. 27(A) to 27(E) are experimental graphs showing the results of the experiments previously described.
Figure 27D:
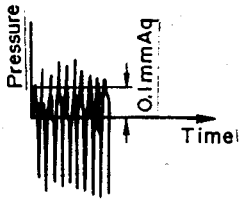
Figure 27B:
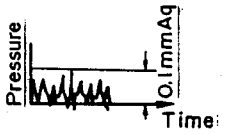
Figure 27E:
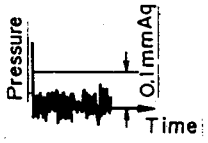
Figure 27C:
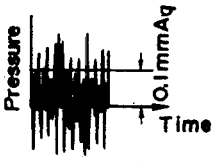

As shown in FIG. 26, the present invention may be applied to coverall 270 having sleeves 272, 272, in which the air passage system 284 includes three portions open to the atmosphere, i.e., neck air passage 286 and cuff air passages 288, 288 of the trousers portions. The neck air passage 286 is communicated to a waist air passage 290 through a back air passage 292. The cuff air passages 288, 288 are each communicated to the waist air passage 290 through a leg air passage 294 which extends along the outside of the associated leg portion. The waist air passage 290 opens at its inside to the interior of the coverall 270. The waist air passage 290 is connected to an outlet tube 296 for exhausting air form it.

In the dust-free garments in FIGS. 22–26, their vest bodies 190 are formed of meshed nylon or polyester cloth as in the vest 180 in FIG. 19. Instead of the nylon or polyester cloth, conventional electrically conductive cloth may be used in the present invention for preventing electrostatic charges from being generated due to friction between the dust-free garment and the outer garment or between the dust-free garment and the underclothes. Further, disadvantages in the clean room due to electrostatic phenomena are easily eliminated by grounding the dust-free garment of electrically conductive cloth.

In the appended claims, the terms "air-impermeable member" and "air-impermeable tube" respectively refer to a member and a tube that are air-impermeable or having such high air permeation resistance that air may be sucked from the air entrance of the air passage system and smoothly passes through the system to its outlet when the dust collector is actuated.

What is claimed is:

1. A dust-free garment comprising:

a garment body having at least one garment opening in communication with the atmosphere outside said garment;

an air passage system, attached to the garment body and having an outlet to communicate to a dust collector for exhausting air therein to the dust collector to filter air exhausted from inside the garment to said outside atmosphere; and air entrance means located in the vicinity of each opening to surround said opening, said air entrance means being in communication with said air passage system for introducing air into the air passage system, whereby air is introduced into said air passage system through said air entrance means by producing negative air pressure around said opening.

2. A dust-free garment as recited in claim 1, wherein the garment body comprises an air-impermeable covering member and an air-permeable lining attached to the covering member, and wherein the air passage system comprises a suction tube having suction through-holes along its length for entering air thereinto, the suction tube being interposed between the covering member and the lining.

3. A dust-free garment as recited in claim 1, wherein the garment body comprises an air-permeable covering member and an air-permeable lining attached to the covering member, and wherein the air passage system comprises a suction tube having suction through-holes along its length for entering air thereinto, the suction tube being interposed between the covering member and the lining.

4. A dust-free garment as recited in claim 2 or 3, wherein the air entrance means comprises a length of entrance tube having through entrance holes for entering air form the atmosphere outside said garment body thereinto, the entrance tube connected to the suction tube for mutual communication, such that the air exhausted from said air passage system is comprised of air from outside said garment body and air from inside said garment body.

5. A dust-free garment as recited in claim 4, wherein the entrance tube is substantially in the shape of a ring, the entrance tube having the air entrance holes formed at regular angular intervals, and wherein the entrance tube is attached to said garment body at one of said openings.

6. A dust-free garment as recited in claim 5, wherein the garment body has at least two openings wherein the suction tube is provided in a plurality, and wherein the air passage system further comprises an accumulating chamber, communicated to each suction tube for introducing air thereinto, the accumulating chamber being communicated to the outlet.

7. A dust-free garment as recited in claim 6, wherein the suction tubes are provided with flexible means for providing flexibility thereto.

8. A dust-free garment as recited in claim 7, wherein the flexible means comprises one of both a meandered portion, looped portion and bellows portion of the suction tubes.

9. A dust-free garment as recited in claim 8, further comprising a pair of gloves, and wherein the air passage system further comprises glove suction tubes, each adapted to communicate at one end thereof to the accumulating chamber and at the other end to the inside of a corresponding glove for sucking air from the glove.

10. A dust-free garment as recited in claim 9, wherein the dust collector is a portable dust collector adapted to be communicated to the outlet and to be attached to a user, the dust collector comprising a suction pump for sucking air from the outlet, a filter for filtering the sucked air and electric power supply means for supplying electric power to the suction pump.

11. A dust-free garment as recited in claim 10, wherein the dust collector is adapted to be mounted to at least one shoe of the user.

12. A dust-free garment as recited in claim 1, wherein the air passage system comprises: an air impermeable tube attached to the garment body and having the outlet; and an air-permeable resilient spacer enclosed in the air-impermeable tube so as to extend along the air-impermeable tube.

13. A dust-free garment as recited in claim 12, wherein the air passage system further comprises a flexible tube core disposed within the air-impermeable tube to extend along the air-impermeable tube, the flexible tube being covered with the air-permeable resilient spacer.

14. A dust-free garment as recited in claim 12 or 13, wherein the garment body is made of meshed cloth.

15. A dust-free garment as recited in claim 14, wherein the air-impermeable tube has an entrance opening situated in the vicinity of a garment opening, and wherein the air entrance means comprises a meshed cloth member attached to the air-impermeable tube to close the entrance opening, the meshed cloth member covering part of the spacer located in the vicinity of the entrance opening.

16. A dust-free garment as recited in claim 15, wherein the at least one garment opening is a neck opening of the garment body, and wherein the air passage system comprises a neck air passage extending along the periphery of the neck opening, the entrance opening formed through the neck air passage to extend along the periphery of the neck opening.

17. A dust-free garment as recited in claim 16, wherein the air passage system further comprises a back air passage extending vertically along the center of a back of the garment body, one end of the back air passage communicated to the neck air passage and the other end in communication with the dust collector.

18. A dust-free garment as recited in claim 17, wherein the neck air passage has opposite ends facing at the front of the garment body, and wherein the air passage system comprises a pair of circumferential air passages extending from respective ends of the neck air passage through sides of the garment body to the back air passage for communicating to the back air passage.

19. A dust-free garment as recited in claim 18, wherein the garment openings further include a pair of sleeve openings, wherein the air passage system comprises a pair of sleeve opening air passages extending along peripheries of respective sleeve openings, each sleeve opening air passage having another entrance opening forxed therethrough to extend along the periphery of the sleeve opening, and wherein the sleeve opening air passages are communicated to the side air passages.

20. A dust-free garment as recited in claim 17, wherein the garment openings further include a pair of sleeve openings, wherein the air passage system comprises a pair of sleeve opening air passages extending along peripheries of respective sleeve openings, each sleeve opening air passage having another entrance opening formed therethrough to extend along the periphery of the sleeve opening, and wherein the sleeve opening air passages are communicated to the back air passages.

21. A dust-free garment as recited in claim 17, wherein the garment body comprises front body halves, having opposite vertical edges, and a zipper attached to the opposite vertical edges of the front body halves for fastening the front body halves together, the garment body having a pair of sleeve openings and a lower end for defining a waist opening, wherein the air passage system further comprises: a waist periphery air passage, extending along the periphery of the waist opening to communicate to the other end of the back air passage; a pair of sleeve opening air passages extending along peripheries of respective sleeve openings, each sleeve opening air passage having another entrance opening formed therethrough to extend along the periphery of the sleeve opening, the waist air passage communicated to the outlet and the sleeve opening air passages communicated to both the neck air passage and the waist air passage.

22. A dust-free garment as recited in claim 17, wherein the garment body is in the shape of a coverall having a waist portion and a pair of leg portions, each leg portion having a leg opening, wherein the air passage system further comprises: a waist portion air passage, extending in the waist portion to communicate to the other end of the back passage, and a pair of leg opening air passages extending along respective leg openings and commnunicating to the waist portion air passage, the waist portion air passage communicated to the outlet.

23. A dust-free garment as recited in claim 16, wherein the neck opening comprises a stand-up collar having a sufficient height such that dust from a user's head is sucked into the entrance opening of the neck air passage.

24. A dust-free garment as recited in claim 16, wherein the dust collector is a portable dust collector which communicates with the air passage system through the outlet and may be attached to a user, the dust collector comprising a suction pump for sucking air from the outlet, a filter for filtering the sucked air and electric power supply means for supplying electric power to the suction pump.

25. A dust-free garment as recited in claim 1, wherein said garment body includes a neck opening and sleeve openings.

26. A dust-free garment as recited in claim 1, wherein said negative pressure at said air entrance means results from suction exerted from said dust collector.

* * * * *